United States Patent [19]

Wood

[11] 4,198,222

[45] Apr. 15, 1980

[54] CONDENSATION PREVENTING ARRANGEMENT FOR INTERIOR OF A HOUSEHOLD REFRIGERATOR

[75] Inventor: Ronald P. Wood, Floyd Knobs, Ind.

[73] Assignee: General Electric Company, Louisville, Ky.

[21] Appl. No.: 856,373

[22] Filed: Dec. 1, 1977

[51] Int. Cl.[2] ..... F25D 21/00; F25D 21/14; F25D 11/02; F25B 39/02

[52] U.S. Cl. ..... 62/272; 62/285; 62/443; 62/515; 165/110; 165/133

[58] Field of Search ..... 62/93, 268, 271, 272, 62/281, 315, 316, 443, 515, 85, 531; 165/110, 133, 181

[56] References Cited

U.S. PATENT DOCUMENTS

| | | | |
|---|---|---|---|
| 2,876,631 | 3/1959 | Bailey | 62/515 |
| 3,320,761 | 5/1967 | Gelbard | 62/443 |
| 3,327,493 | 6/1967 | Jacobus | 62/443 |
| 3,711,327 | 1/1973 | Blumenthal et al. | 165/133 |
| 3,805,545 | 4/1974 | Buchser et al. | 62/443 |
| 3,905,203 | 9/1975 | Jacob | 62/272 |

*Primary Examiner*—Lloyd L. King
*Attorney, Agent, or Firm*—Frederick P. Weidner; Radford M. Reams

[57] ABSTRACT

A combination refrigerator has a fresh food compartment and a freezer compartment separated by a partition. To prevent unsightly moisture droplets from forming on the partition surface facing the fresh food compartment, the partition surface is coated with a wetting agent. Any moisture condensation forming spreads out into a thin sheet which minimizes appearance problems. Further, the thin sheet evaporates readily when the door is closed.

6 Claims, 2 Drawing Figures

CONDENSATION PREVENTING ARRANGEMENT FOR INTERIOR OF A HOUSEHOLD REFRIGERATOR

BACKGROUND OF THE INVENTION

The present invention relates generally to combination refrigerators having fresh food and freezer compartments separated by a partition. More particularly, the invention relates to the prevention of unsightly condensation forming on the partition surfaces facing the fresh food compartment.

In such refrigerators, as a result of thermal leakage, the partition surface facing the fresh food compartment is normally cooler than the air temperature within the fresh food compartment. In the case of a simple partition, the thermal leakage is through the partition to the freezer compartment. In the case of a partition which includes an evaporator for forced-air cooling of the compartments, the thermal leakage is to the evaporator as well as to the freezer compartment.

Under some conditions of refrigerator usage, for example, with frequent door opening during high ambient humidity conditions, moisture tends to condense on the cool partition surface facing the fresh food compartment. Typically this partition surface is either plastic or painted steel. The moisture condensation typically forms into unsightly droplets.

The problem is particularly severe in refrigerators of the "top-mount" configuration wherein the freezer compartment is above the fresh food compartment. In this case, the cool partition surface is the top of the fresh food compartment. Large droplets of water forming, in addition to being unsightly, drop onto food stored in the compartment.

Many prior art refrigerators utilize heaters to warm the partition surface sufficiently to prevent the formation of moisture thereon. While this arrangement performs satisfactorily, it has the disadvantage of increased energy consumption. The increased energy consumption is a result not only of the energy required to operate the heaters, but of the additional thermal load on the refrigeration system.

SUMMARY OF THE INVENTION

The present invention satisfactorily solves the foregoing problem through providing a coating of a wetting agent on the cool partition surface. The wetting agent reduces surface tension so that the moisture spreads out in a very thin sheet. This overcomes the appearance problem created by the droplets since they are no longer visible as separate droplets. Further, in the case of a "top mount," the possibility of the droplets becoming sufficiently large and heavy to cease to adhere to the top wall of the fresh food compartment and to fall on articles of food within the fresh food compartment is eliminated.

Moreover, in a forced-air refrigerator particularly, cold dry air from the evaporator circulating through the fresh food compartment causes the moisture on the partition surface to evaporate during periods when the door is closed. Having the condensation as a relatively thin sheet of moisture, rather than droplets, speeds up this evaporation process. As a result, permanent accumulation of moisture is prevented.

The evaporator removes the moisture from the air received from the fresh food compartment as the air is circulated thereover. Of course, the evaporator must be eventually defrosted to remove this moisture, but the moisture is no longer present within the fresh food compartment. Thus, the present invention not only prevents the moisture from forming into relatively large droplets but also enables the moisture to be readily removed whenever the door of the fresh food compartment is closed.

An object of this invention is to provide an arrangement for reducing condensation within the fresh food compartment of a household refrigerator.

Another object of this invention is to provide an arrangement for preventing the accumulation of moisture within the higher temperature compartment in a two compartment refrigerator.

Other objects of this invention will be readily perceived from the following description, claims, and drawing.

BRIEF DESCRIPTION OF THE DRAWINGS

The attached drawing illustrates a preferred embodiment of the invention, in which.

DESCRIPTION OF THE PREFERRED EMBODIMENT

In the following detailed description, certain specific terminology is utilized and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
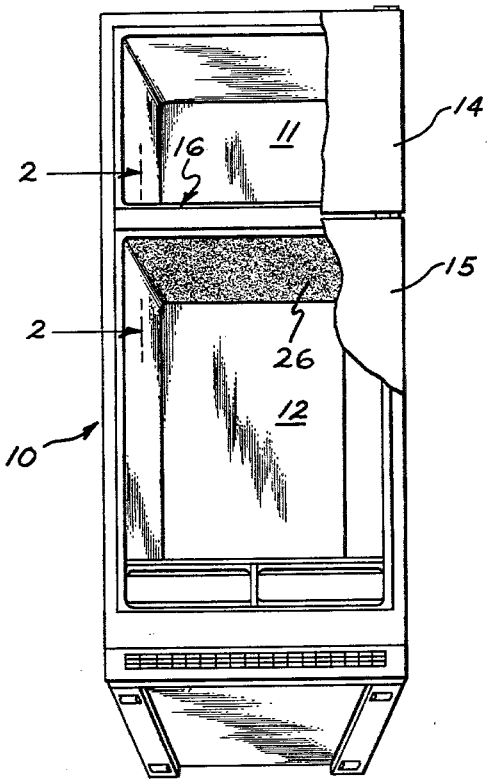
FIG. 1 is a front elevational view of a refrigerator cabinet having the coating of the present invention on the top wall of the fresh food compartment.

Referring to the drawing and particularly to FIG. 1, there is shown a combination refrigerator 10 having a freezer compartment 11 and a fresh food compartment 12. An upper door 14 closes the freezer compartment 11, and a lower door 15 closes the fresh food compartment 12.

Figure 2:
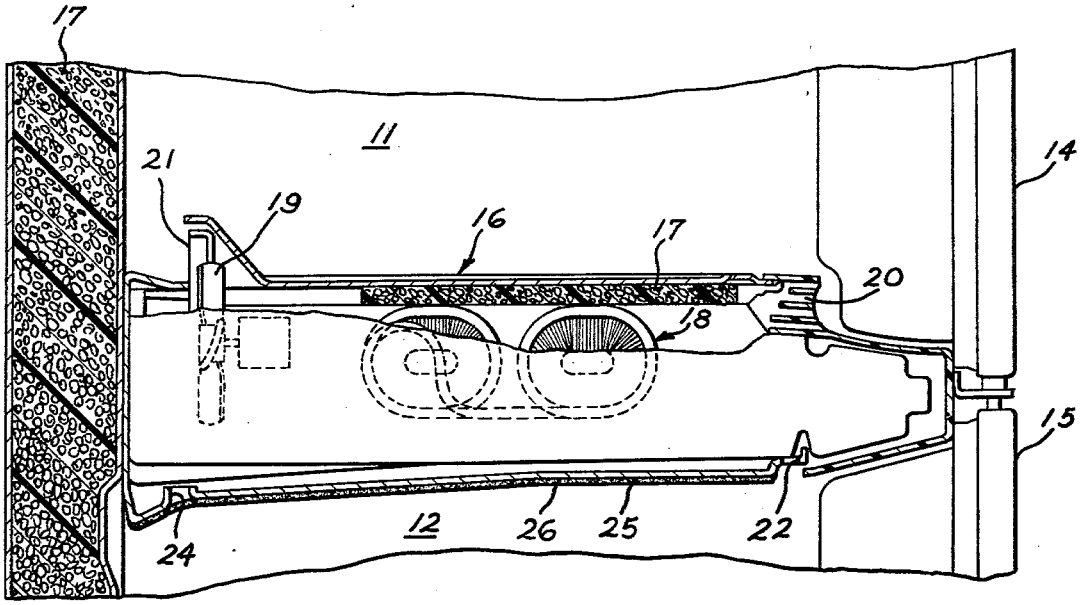
FIG. 2 is a fragmentary sectional view of a portion of the cabinet of FIG. 1 and taken along line 2—2 of FIG. 1.

An insulated partition 16 separates the freezer compartment 11 from the fresh food compartment 12. Thermal insulation 17 (FIG. 2) fills the outside walls of the compartments 11 and 12, as well as a portion of the partition 16.

In the particular embodiment illustrated, the insulated partition 16 has an evaporator 18 of a refrigerant system disposed within a compartment therein. Air from the freezer compartment 11 and the fresh food compartment 12 is circulated over the evaporator by a fan 19.

The fan 19 withdraws air from the freezer compartment 11 through openings 20, passes the air over the evaporator 18, and returns the cooled air to the freezer compartment 11 through an opening 21. The fan 19 additionally withdraws air from the fresh food compartment 12 through an opening 22, passes the air over the evaporator 18, and then back to the fresh food compartment 12 through an opening 24.

The partition 16 has a surface 25 facing the fresh food compartment 12. The partition surface 25 is cooled by thermal leakage to a temperature lower than the air temperature within the fresh food compartment. Thermal leakage occurs even though the partition 16 includes insulation material 17 because commonly-employed insulation materials still have sufficient thermal conductivity in the thickness employed in this application.

In the illustrated embodiment, much of the thermal leakage is directly to the evaporator 18 and the air circulating thereover. Additional leakage occurs to the freezer compartment 11. In the event a simple divider (not shown) was employed which did not include an evaporator, substantially all of the leakage would be to the freezer compartment. One example of such a simple partition would be in a refrigerator configuration having an evaporator on the rear wall of the freezer compartment. One such configuration is a "side-by-side" refrigerator wherein the freezer compartment is on one side of the fresh food compartment, and both are relatively tall.

Under circumstances such as high ambient humidity, when the door 15 is open, sufficient moisture enters the compartment 12 to be condensed on the cool partition surface 25.

To prevent this moisture from forming into droplets on the surface of 25, a coating 26 of a wetting agent is applied to the surface 25. The thickness of the coating 26 is exaggerated for clarity of illustration. A suitable coating thickness would be approximately 0.001 inch to 0.002 inch for example.

The coating 26 can be any suitable material capable of reducing the surface tension of the moisture so that it cannot form into relatively large droplets and will form into a relatively thin sheet. One suitable coating material is alumina. The coating 26 may be applied to the surface 25 by any suitable means such as spraying or dipping.

While a coating of alumina is not normally considered permanent, semi-permanent adhering of the coating 26 is believed to be sufficient since the coating 26 is not subjected to abrasive use in this particular application. It will be understood that the present invention is not limited to alumina as a wetting agent, and any non-toxic wetting agent capable of permanently or semi-permanently adhering to the surface 25 may be employed.

While the present invention has shown and described the coating 26 as being utilized with a two-door refrigerator cabinet having a forced air cooling system, it should be understood that the coating may be utilized with any refrigerator having a surface on which moisture condenses. Examples of the refrigerators are models having a single outside door, and models having evaporators located other than in the partition, both "top-mount" and "side-by-side." The invention is particularly advantageous when employed in a forced-air cooled refrigerator because the thin film of moisture is readily evaporated when the door is closed.

An advantage of this invention is that it reduces the power consumption of a household refrigerator. Another advantage of this invention is that it eliminates the expense of a heater to prevent moisture from accumulating on a partition surface facing the fresh food compartment of a refrigerator. A further advantage of this invention is that it prevents accumulation of condensation within the fresh food compartment of a household refrigerator. Still another advantage of this invention is that it increases the moisture surface area to enable quicker evaporation of the moisture within the fresh food compartment.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is :

1. A refrigerator comprising:

a fresh food compartment;

a freezer compartment;

a partition between said compartments;

said partition having a partition surface facing said fresh food compartment, said partition surface being cooled by thermal leakage to a temperature lower than the air temperature within said fresh food compartment, said partition surface having substantially its entire area non-porous so that moisture condensation cannot flow or soak therethrough; and alumina coating said partition surface to permit any moisture condensation forming thereon to spread out in a thin sheet.

2. The refrigerator according to claim 1, wherein said freezer compartment is positioned above said fresh food compartment and said partition surface is the top of said fresh food compartment and is substantially horizontal.

3. The refrigerator of claim 1, which further comprises:

a door closing said fresh food compartment; and a forced air cooling arrangement including an evaporator and a fan for recirculating fresh food compartment air over said evaporator, whereby cool dry air from said evaporator tends to evaporate the thin sheet of moisture when the door is closed.

4. The refrigerator according to claim 1, wherein said freezer compartment is positioned above said fresh food compartment and said partition surface is the top of said fresh food compartment and is substantially horizontal.

5. The refrigerator according to claim 1 in which said partition surface is substantially horizontal.

6. The refrigerator according to claim 1 in which the coating of the alumina has a thickness in the range of 0.001 inch to 0.002 inch.

* * * * *